US007014498B1

(12) United States Patent
Munoz

(10) Patent No.: US 7,014,498 B1
(45) Date of Patent: Mar. 21, 2006

(54) SAFETY CLOSURE FOR CONNECTORS WITH PIVOTING COVER

(75) Inventor: Luis Miguel Munoz, Valls (ES)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 10/904,373

(22) Filed: May 9, 2005

(51) Int. Cl.
*H01R 13/62* (2006.01)

(52) U.S. Cl. ..... 439/473; 439/352

(58) Field of Classification Search ..... 439/473, 439/468, 352, 142–144
See application file for complete search history.

(56) References Cited

U.S. PATENT DOCUMENTS

| | | | | |
|---|---|---|---|---|
| 4,035,051 | A * | 7/1977 | Guy | 439/464 |
| 5,344,194 | A | 9/1994 | Hatagishi et al. | 285/26 |
| 5,947,762 | A * | 9/1999 | Katsuma | 439/468 |
| 6,012,933 | A | 1/2000 | Katsuma | 439/157 |
| 6,478,608 | B1 * | 11/2002 | Grant et al. | 439/468 |
| 6,517,364 | B1 | 2/2003 | Muramatsu et al. | 439/157 |
| 6,540,547 | B1 * | 4/2003 | Zweigle | 439/468 |
| 6,544,066 | B1 * | 4/2003 | Fukase | 439/352 |
| 6,595,795 | B1 * | 7/2003 | Nakamura | 439/489 |
| 6,623,287 | B1 | 9/2003 | Hatagishi et al. | 439/157 |
| 6,769,929 | B1 * | 8/2004 | Saka et al. | 439/352 |
| 6,817,888 | B1 * | 11/2004 | Kozono et al. | 439/468 |
| 6,824,417 | B1 * | 11/2004 | Nimura | 439/352 |

* cited by examiner

*Primary Examiner*—Gary F. Paumen
(74) *Attorney, Agent, or Firm*—Bruce E Harang

(57) ABSTRACT

Starting from a base body (1) and a cover (2) swivel-mounted thereon, enclosing inside the connector itself, wherein the cover (2) incorporates side projections (5) which, in combination with the deformable character of said cover, allow for the unlocking thereof with regard to the body, for the opening and closing thereof, the cover (2) incorporates a safety element (8) materialized in a stiff, U-shaped part, adaptable to the upper portion of the cover in correspondence with the location area of the side projections (5), such that the middle branch of said element (8) can be substantially spaced from the cover (2) in a pre-assembly position, or be adapted to said cover in the working position, in which its side branches (9) penetrate inside the cover (2), internally adapting to the side projections (5), stiffening them to make the accidental opening of the cover impossible. The safety element (8) furthermore incorporates ribs stabilizing it in both the pre-assembly position and working position.

6 Claims, 3 Drawing Sheets

SAFETY CLOSURE FOR CONNECTORS WITH PIVOTING COVER

OBJECT OF THE INVENTION

The present invention refers to a safety closure that has been specially designed for suitably fixing the pivoting cover of an electric connector to its corresponding body, preventing the accidental opening of the connector.

The invention is encompassed within the automotive field, in which the connectors used in electric circuits must be duly protected by a cover, and in which the usual vibrations during operation of the vehicle can cause an accidental and unwanted opening.

BACKGROUND OF THE INVENTION

In the previously mentioned field of practical application, connectors are used for the electric circuitry of vehicles, structured by means of a base body on which a cover closing the opening of the body and protecting the connector is hinge-assembled, i.e. with a pivoting nature, a side outlet for the wires associated to the connector itself being arranged between body and cover.

The cover pivots on the base body at its area opposite to the wire outlet, and said cover incorporates on its side walls projections or retention means of the body on the connector, determining a tongue and groove coupling stabilizing the cover when it is in a closed position.

In practice, due to the effect of vibrations of the vehicle or due to slight deformations of the material over time, this closure becomes unsafe, such that the accidental and unwanted opening of the cover frequently occurs.

Several connectors with pivoting cover, also known as lever connectors, can be found in the state of the art, for example U.S. Pat. No. 6,012,933, U.S. Pat. No. 6,623,287, U.S. Pat. No. 6,517,364 and U.S. Pat. No. 5,344,194, but non of them discloses a security device as the one described in the present application.

DESCRIPTION OF THE INVENTION

The safety closure proposed by the invention solves in a fully satisfactorily manner the drawbacks set forth above, inasmuch as it has means for stiffening the side walls of the cover, after the closing thereof, which prevent the necessary deformation so that its opening can occur.

To this end and more specifically, said safety closure, starting from the basic structure of a conventional closure, focuses its features on the incorporation of a stiff part, which constitutes the safety element, a stiff part materialized in a U-shaped flat bar, the middle branch of which is intended for being adapted to the upper and outer side of the cover, whereas its side branches work in slits operatively made in the also side areas of the cover, said side branches having, on the inner edge of their free end, respective notched profile ribs acting like interlocking spears on complementary ribs of the cover when said safety element adopts its working position, in which its middle branch is adapted to the upper side of the cover.

Thus when the safety element adopts a pre-assembly position, in which its middle branch is substantially spaced with regard to the upper side of the cover, said safety element is inoperative, and the side walls of the cover can be easily deformed to carry out the opening and closing of the connector, a situation which is maintained stable as a result of the existence, also on the side branches of the safety element, of other, more drawn in ribs with regard to those previously mentioned and which butt on the upper side of the cover, whereas when the safety element passes to the working situation and its side branches completely penetrate inside the pivotal cover, the side walls of the latter stiffen, making the necessary deformation thereof for carrying out its opening impossible, as previously stated.

It only remains to lastly point out that the safety element incorporates on its middle branch a shaping determinant of a type of thumbcut which allows acting on said element with a suitable tool, such as the tip of a screwdriver, for example, for unlocking the cover when it is necessary to access the inside of the connector after the original assembly thereof.

DESCRIPTION OF THE DRAWINGS

To complement the description being made and for the purpose of better understanding the features of the invention, according to a practical embodiment example thereof, a set of drawings is attached as an integral part of said description, in which drawings the following has been shown with an illustrative and non-limiting character.

PREFERRED EMBODIMENT OF THE INVENTION

Figure 1:
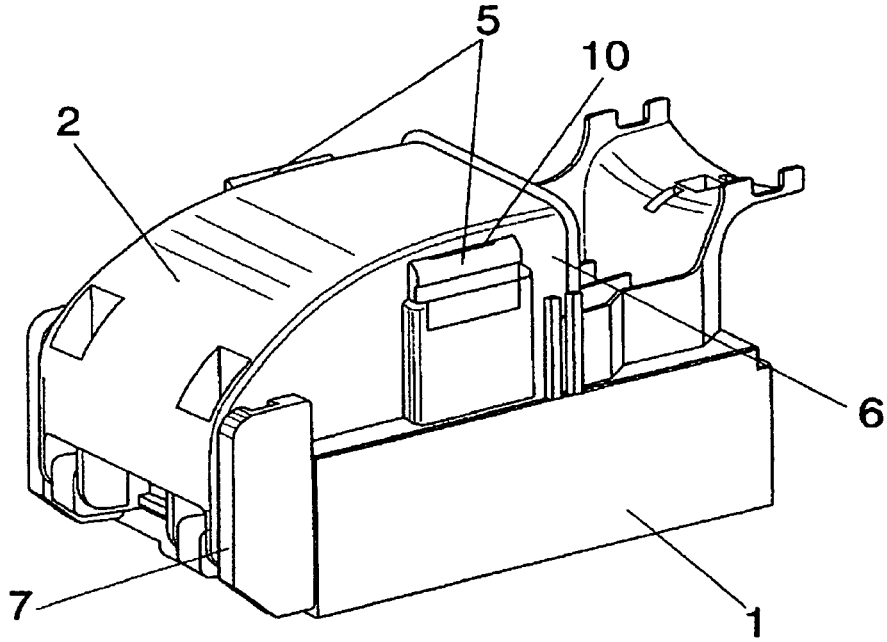
FIG. 1 shows a perspective view of a standard connector with a pivoting cover, which is shown in a closed position.
Figure 2:
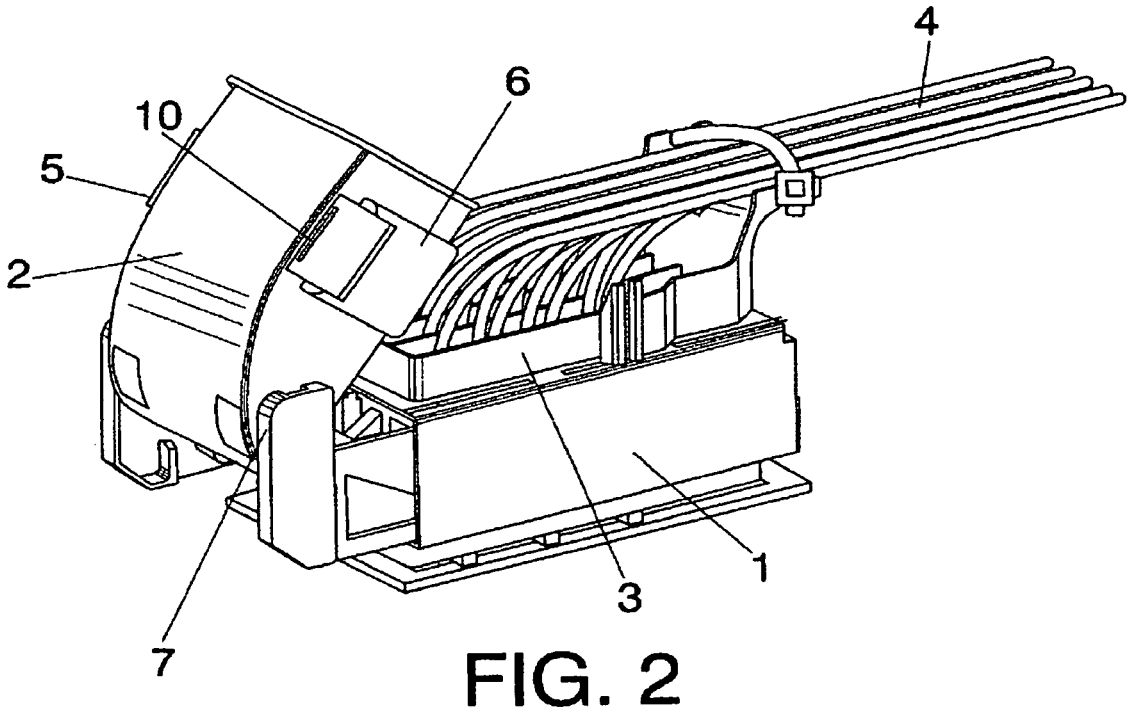
FIG. 2 shows a perspective view similar to the previous figure in which the connector is in an open position and with a group of wires duly connected thereto.
Figure 3:
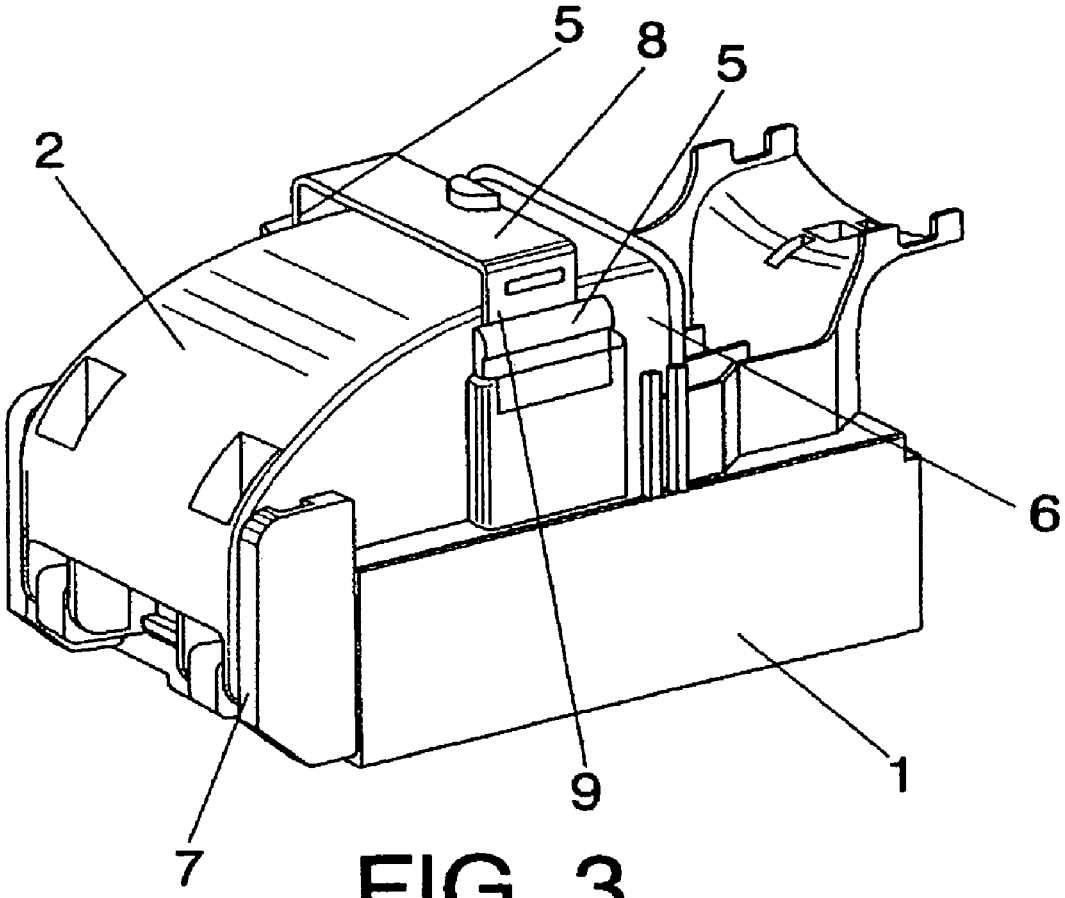
FIG. 3 shows a view similar to FIG. 1, wherein the connector is now carried out according to the object of the invention.

As was just stated, FIGS. 1 and 2 show a standard connector in which a base body (1) and a pivoting cover (2) participate, such that the connector (3) itself, from which the wires (4) project, is arranged inside the body (1), said connector (3) being protected by the lid or cover (2) when it is in the closed position shown in FIG. 1.

In this standard solution, the cover (2) has side projections (5) on its also side walls (6), opposite to its hinging or pivoting area (7), such that the plastic nature of said cover (2) allows for the deformation of said side walls (6) when said projections (5), necessary for unlocking the cover (2) of the body (1), are pressed on, and such that said cover passes from the position shown in FIG. 1 to the position shown in FIG. 2.

Starting from this basic structure, the object of the invention is focused on incorporating a safety element (8) in the pivoting cover (2), said safety element materialized in a flat bar of a stiff material, such as a plastic U-shaped flat bar, for example, the middle branch of which, corresponding to reference (8), has a length coinciding with the width of the cover (2), whereas its side branches (9) penetrate inside the cover (2) through the slits (10) themselves delimiting the upper portion of the side projections or retention means (5).

Said side branches (9) of the safety element (8) incorporate on their end and on their inner side respective angular or notched profile ribs (111) acting as interlocking means of the safety element (8) in a working position, locking said safety element with regard to complementary ribs (12)

existing inside the cover (2) and suitably spaced from the slits (10) for accessing the inside thereof.

Figure 5:
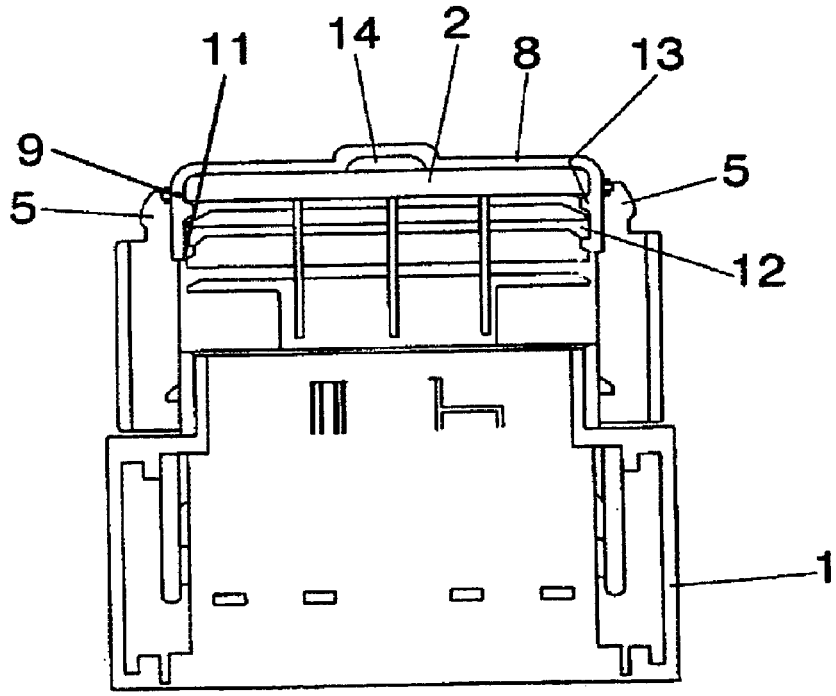
FIG. 5 shows a view similar to FIG. 4, but in which the safety element is in a working position.

Thus, and as previously stated, in the safety element working position shown in FIG. 5, said element is immobilized with regard to the cover (2), its side branches (9) acting as stiffening means for the side projections (5) of the cover and, therefore, preventing the necessary deformation thereof so that its opening can occur.

Figure 4:
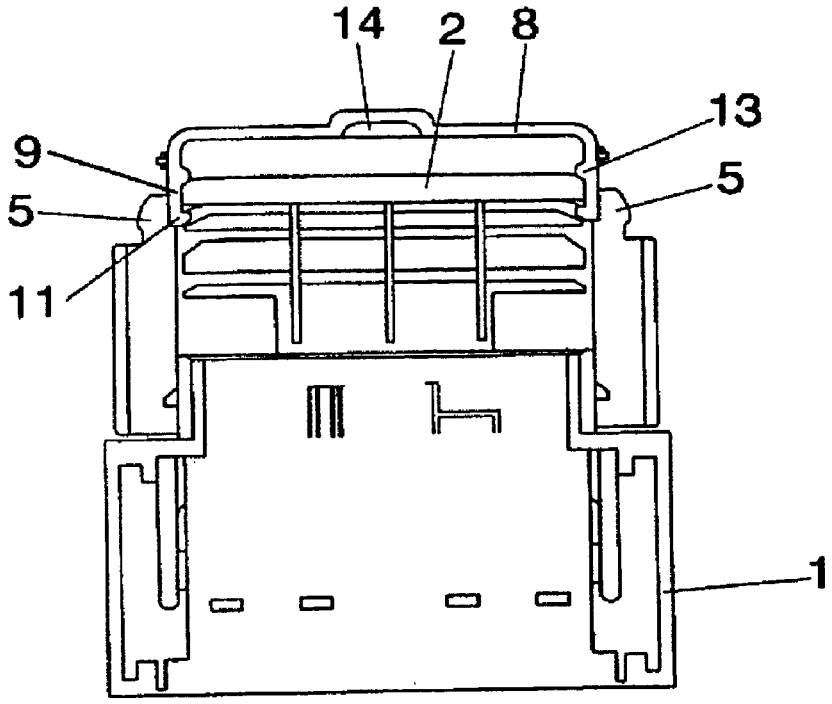
FIG. 4 shows a cross sectional view of a detail of the assembly shown in FIG. 3, in a pre-assembly position of the safety element.

On the contrary, in the pre-assembly position shown in FIG. 4, the middle branch (8) of the safety element is considerably spaced from the cover (2), specifically at a position in which its side branches (9) barely penetrate inside said cover (2), becoming inoperative and allowing for the deformation of the side projections (5) of the latter.

Said pre-assembly position for the safety element (8) shown in FIG. 4 is maintained stable until the moment of arranging the connector as a whole in its worksite, as a result of the existence on its side branches of other ribs (13), initially butting against the upper side of the cover (2) and preventing the accidental shifting of the safety element (8), being necessary to exert considerable pressure thereon so that it reaches the working position shown in FIG. 5, in which it is in turn also maintained completely stable.

Due to a possible subsequent handling of the connector requiring the opening thereof, the actuation of the safety element is facilitated due to the existence on the middle branch (8) thereof of a centered shaping (14) determinant of a type of thumbcut allowing the coupling of a suitable tool, such as the tip of a screwdriver for example, as previously stated, to strongly pull on said element (8) and allowing the ribs (11) to overcome the complementary ribs (12) of the cover and the safety element to again reach the inoperative position shown in FIG. 4, allowing for the opening and closing of the cover (2).

The invention claimed is:

1. A safety closure for electrical connectors with a pivotal cover, of the type in which the connector itself is housed inside a base body which closes by means of a pivotal cover, the pivotal cover incorporating on its side walls side projections for the unlocking of the cover by means of manual pressure exerted thereon, with regard to the base body, characterized in that it incorporates a safety element made of a stiff plastic, U-shaped flat bar, comprising a middle branch (8) having a length coinciding with the width of the cover (2), and side branches (9) susceptible to penetrating inside said cover (2) through slits (10) in the upper portion of the side actuation projections (5), said side branches (9) of said safety element acting as stiffening means for said side actuation projections, preventing the necessary deformation thereof for unlocking the cover (2) with regard to the base body (1).

2. A safety closure for electrical connectors with a pivotal cover according to claim 1, characterized in that said safety element incorporates on the inner side of the free end of each of said side branches (9) respective notched profile ribs (11) which engage complementary ribs (12) operatively arranged inside the cover (2), immobilizing said safety element with regard to said cover (2).

3. A safety closure for electrical connectors with a pivotal cover according to claim 1, characterized in that said safety element further incorporates on the inner portion of said side branches (9), substantially inward with regard to the angular profile ribs (10), other ribs (13) in turn acting as stabilizing elements of safety element when it is in a pre-assembly position, in which said middle branch (8) is considerably spaced from the pivoting cover (2) and in which said side branches (9) are inoperative.

4. A safety closure for electrical connectors with a pivotal cover according to claim 2, characterized in that said safety element further incorporate on the inner portion of said side branches (9), substantially inward with regard to the angular profile ribs (10), other ribs (13) in turn acting as stabilizing elements of said safety element when it is in a pre-assembly position, in which said middle branch (8) is considerably spaced from the pivoting cover (2) and in which said side branches (9) are inoperative.

5. A safety closure for electrical connectors with a pivotal cover according to claim 1, characterized in that the safety element incorporates on its middle branch and in a centered arrangement, a thumbcut shape (14) for unlocking the cover.

6. A safety closure for electrical connectors with a pivotal cover according to claim 2, characterized in that the safety element (8) incorporates on its middle branch and in a centered arrangement, a thumbcut shape shaping (14) thereon for unlocking the cover.

* * * * *